US011313193B2

(12) United States Patent
McGarian

(10) Patent No.: US 11,313,193 B2
(45) Date of Patent: Apr. 26, 2022

(54) WHIPSTOCK

(71) Applicant: Bruce McGarian, Stonehaven (GB)

(72) Inventor: Bruce McGarian, Stonehaven (GB)

( * ) Notice: Subject to any disclaimer, the term of this patent is extended or adjusted under 35 U.S.C. 154(b) by 0 days.

(21) Appl. No.: 16/959,113

(22) PCT Filed: Dec. 11, 2018

(86) PCT No.: PCT/GB2018/053585
§ 371 (c)(1),
(2) Date: Jun. 29, 2020

(87) PCT Pub. No.: WO2019/130015
PCT Pub. Date: Jul. 4, 2019

(65) Prior Publication Data

US 2020/0332614 A1 Oct. 22, 2020

(30) Foreign Application Priority Data

Dec. 29, 2017 (GB) ..... 1722286

(51) Int. Cl.
*E21B 29/06* (2006.01)
*E21B 7/06* (2006.01)

(52) U.S. Cl.
CPC ..... *E21B 29/06* (2013.01); *E21B 7/061* (2013.01)

(58) Field of Classification Search
CPC ..... E21B 7/061; E21B 29/06
See application file for complete search history.

(56) References Cited

U.S. PATENT DOCUMENTS

| | | | | |
|---|---|---|---|---|
| 1,900,164 | A | 3/1933 | Dana et al. | |
| 5,425,419 | A | 6/1995 | Sieber | |
| 5,647,436 | A | 7/1997 | Braddick | |
| 5,871,046 | A * | 2/1999 | Robison | E21B 7/061 166/241.1 |
| 5,881,808 | A | 3/1999 | Rehbock et al. | |
| 2002/0070018 | A1 * | 6/2002 | Buyaert | E21B 23/01 166/255.3 |

(Continued)

OTHER PUBLICATIONS

International Search Report and Written Opinion of the International Searching Authority, dated Feb. 19, 2019, for corresponding International Application No. PCT/GB2018/053585, 13 pages.

(Continued)

*Primary Examiner* — Taras P Bemko
(74) *Attorney, Agent, or Firm* — Klarquist Sparkman, LLP

(57) ABSTRACT

A whipstock comprises a longitudinal axis, a first end and a second end, and a tapering deflection section extending at least part of the way between the first end and the second end. The deflection section has a rear face. The deflection section has a front face, which in use will deflect a milling arrangement in a direction having a component which is perpendicular to the longitudinal axis of the whipstock. The front face has first and second side edges and a width defined between the first and second side edges. A depth of the deflection section is defined as a distance between the rear face and the front face. At at least one point along the length of the deflection surface, the depth of the deflection section at a distance from the first side edge is greater than the depth of the deflection section at the same distance from the second side edge.

20 Claims, 7 Drawing Sheets

(56) References Cited

U.S. PATENT DOCUMENTS

| | | | | |
|---|---|---|---|---|
| 2006/0027359 | A1* | 2/2006 | Carter | E21B 7/061 166/117.6 |
| 2007/0240876 | A1 | 10/2007 | Lynde | |
| 2013/0112397 | A1 | 5/2013 | McKay et al. | |
| 2014/0014343 | A1 | 1/2014 | Saurer | |

OTHER PUBLICATIONS

Search Report for United Kingdom Application No. 1722286.0, dated May 11, 2018.

* cited by examiner

PRIOR ART

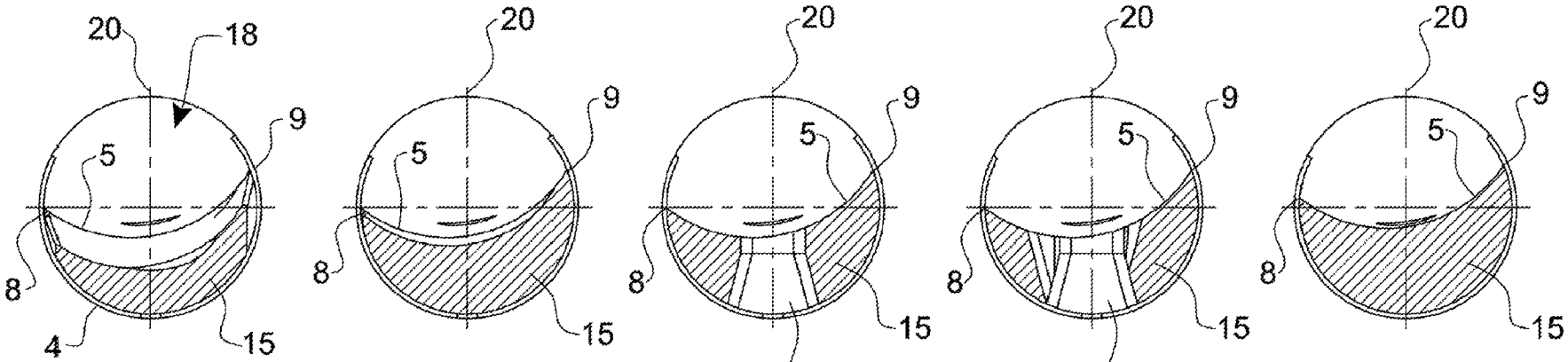
FIG 13a
FIG 13b
FIG 13c
FIG 13d
FIG 13e
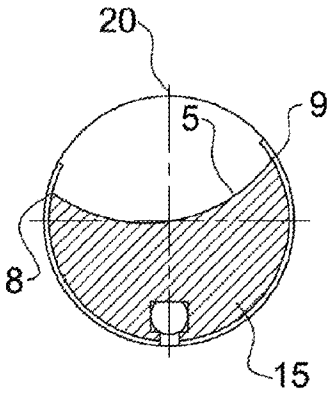
FIG 13f
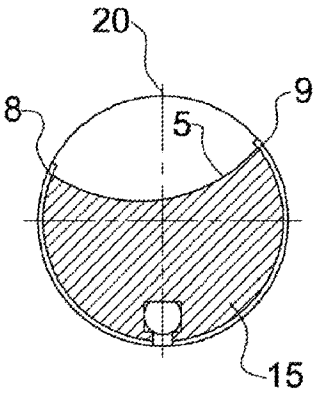
FIG 13g
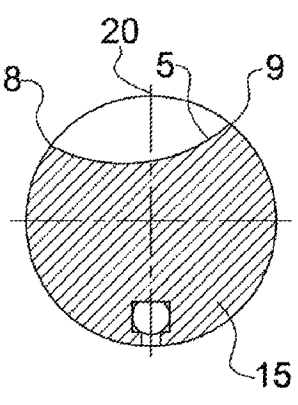
FIG 13h
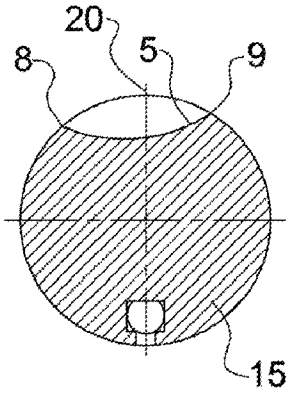
FIG 13i
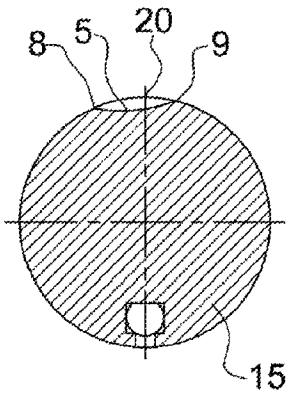
FIG 13j

WHIPSTOCK

CROSS REFERENCE TO RELATED APPLICATIONS

This is the U.S. National Stage of International Application No. PCT/GB2018/053585, filed Dec. 11, 2018, which was published in English under PCT Article 21(2), which in turn claims the benefit of Great Britain Application No. GB1722286.0, filed Dec. 29, 2017. The prior application is incorporated by reference herein in its entirety.

This invention relates to whipstocks.

A whipstock is a component which is introduced into an existing wellbore. The whipstock is tapered, occupying a small amount of the cross-sectional area of the wellbore at its top end, and occupying all or nearly all of the cross-sectional area of the wellbore at its lower end. In between the upper and lower ends there is a tapered deflection face.

One common use of a wellbore is in the formation of a lateral or sidetrack bore, which extends at an angle from an existing wellbore. In this procedure, the whipstock may be fixed in place at a desired depth within the wellbore, and at a desired radial orientation with respect to the wellbore. The whipstock may be fixed in place using an anchor, for example.

A milling head is then pushed downwardly against the deflection face of the whipstock. As it contacts the deflection face, which is inclined at an angle with respect to the longitudinal axis of the wellbore, the milling head will be deflected laterally (i.e. in a direction having a component which is perpendicular to the longitudinal axis of the wellbore). The milling head will therefore be forced sideways onto the casing of the wellbore, and will mill an elongate aperture (or window) into the casing. The same milling head, or one or more other milling/drilling heads, may then be used to begin the drilling of a new bore into the formation around the original bore, with this new bore being at an angle to the original wellbore.

Once this procedure has been completed, the whipstock may be retrieved from the wellbore, or alternatively may be left in place.

It is an object of the invention to provide an improved whipstock.

Accordingly, one aspect of the present invention provides a whipstock having a longitudinal axis, a first end and a second end, and a tapering deflection section extending at least part of the way between the first end and the second end, wherein: the deflection section has a rear face; the deflection section has a front face, which in use will deflect a milling arrangement in a direction having a component which is perpendicular to the longitudinal axis of the whipstock, the front face having first and second side edges and a width defined between the first and second side edges; a depth of the deflection section is defined as the distance between the rear face and the front face; and at at least one point along the length of the deflection surface, the depth of the deflection section at a distance from the first side edge is greater than the depth of the deflection section at the same distance from the second side edge.

Advantageously, the depth of the whipstock at the distance from the first side edge is at least 5% greater than the depth of the whipstock at the distance from the second side, is preferably at least 10% more than the depth of the whipstock at the distance from the second side, and is more preferably more than 20% greater than the depth of the whipstock at the distance from the first side edge.

Preferably, the distance is 5% of the width, is 10% of the width, or is 20% of the width, in a direction from the respective edge towards the centre of the width of the front face.

Conveniently, the front face of the whipstock has a first section, which is near to or adjoins the first edge, and a second section which is near to or adjoins the second edge.

Preferably, the radius of curvature of the second section is less than the radius of curvature of the first section.

Advantageously, the radius of curvature of the second section is less than the radius of curvature of the first section by at least 5%, or preferably by at least 10%, and more preferably by at least 20%.

Preferably, the first and second sections have the same or substantially the same radius of curvature.

Conveniently, the first and second sections of the front face meet at an angle.

Advantageously, at least one of the first and second parts of the front face is straight or substantially straight.

Preferably, the radius of curvature of the front face is constant or substantially constant across the width of the front face.

Conveniently, the front face has a centre of curvature which is offset with respect to a centre of curvature of the rear face.

Advantageously, at at least one point along its length the whipstock has a centreline thereof defined, the centreline passing through the longitudinal axis of the whipstock at a predetermined angle.

Preferably, the centreline is defined as being aligned or substantially aligned with respect to one or more attachment elements at one or both of the first and second ends of the whipstock.

Conveniently, the whipstock has a connection arrangement at one of the first and second ends thereof, to allow the whipstock to be connected to a further component so that the whipstock and the further component may pivot with respect to each other about a pivot axis, and wherein the centreline is defined as being perpendicular or substantially perpendicular to the pivot axis.

Advantageously, the connection arrangement is at the end of the whipstock nearest to the wider part of the tapering deflection section.

Preferably, the centreline is defined as being aligned or substantially aligned with an initial ramp, which is provided at the first end of the whipstock, and which will guide a milling head as it first contacts the whipstock during use.

Conveniently, the initial ramp has a concave face, and wherein the centreline is defined as being aligned or substantially aligned with an axis of symmetry of the initial ramp.

Advantageously, the initial ramp has a straight or substantially straight face, and wherein the centreline is defined as being perpendicular or substantially perpendicular to the face of the initial ramp.

Preferably, the centre of curvature of the front face is offset with respect to the centre of curvature of the rear face in a direction which is perpendicular to the centreline.

Conveniently, the depth is defined in a direction which is parallel with the centreline.

Advantageously, the depth is defined in a direction which is generally perpendicular to a line which extends between the first and second side edges.

Preferably, the depth of the deflection section at a distance from the first side edge is greater than the depth of the deflection section at the same distance from the second side edge for all or substantially all of the length of the deflection section of the whipstock.

Conveniently, the depth of the deflection section at a distance from the first side edge is greater than the depth of the deflection section at the same distance from the second side edge for only a part of the length of the deflection section of the whipstock.

Advantageously, the amount by which the depth of the deflection section at a distance from the first side edge is greater than the depth of the deflection section at the same distance from the second side edge varies over the length of the deflection section.

Preferably, the depth of the deflection section at a distance from the first side edge is greater than the depth of the deflection section at the same distance from the second side edge by a greater amount near the end of the whipstock nearest to the narrower part of the tapering deflection section.

Conveniently, a reinforcement arrangement is provided on or as part of the front face of the deflection section, the depth of the deflection section including the reinforcement arrangement.

Advantageously, the reinforcement arrangement includes a reinforcement element which is provided on only one side of the front face.

Preferably, the reinforcement arrangement includes a reinforcement element which has a greater depth on one side of the width of the front face than on the other side of the width of the front face.

Another aspect of the present invention provides a method of forming an aperture in the casing of a wellbore, comprising the steps of: providing a whipstock according to any preceding claim; setting the whipstock in place in a wellbore at predetermined depth, and at a predetermined radial orientation with respect to the wellbore; and driving a milling head downwardly over the front face of the whipstock, to mill an aperture in a casing of the wellbore.

Conveniently, during the milling of the aperture, the milling head is in contact with the front face of the whipstock; and during the milling of the aperture, the milling head is rotated in a direction such that a point on the outer surface of the milling head passes across the front face of the whipstock in a direction which passes from the first side edge to the second side edge.

A further aspect of the present invention provides a method of forming a whipstock, comprising the steps of: providing a body; providing a cutter; and using the cutter to mill away at least part of the body and thereby form a tapered deflection section having front face, an outer surface of the body which has not been milled by the cutter, generally opposite the front face, comprising a rear face of the deflection section, wherein at least part of the body is milled away by the cutter such that, at at least one point along the length of the deflection surface, the depth of the deflection section at a distance from the first side edge is greater than the depth of the deflection section at the same distance from the second side edge Advantageously, the body is initially, over at least a region of its length, substantially cylindrical, having a first diameter; the cutter is shaped so that it removes material from the body in a shape which is circular or part-circular, or substantially circular or part-circular, having a second diameter which is greater than the first diameter; and during at least part of the milling operation, the centre of curvature of the circular or part-circular shape is offset with respect to the centre of curvature of the body, in a direction which is perpendicular to a centreline of the body.

In order that the invention may be more readily understood, embodiments thereof will now be described, by way of example, with reference to the accompanying drawings in which:

FIGS. 1 to 3 are views of known whipstocks or deflectors;

FIGS. 4*a* to 6*b* show planes of a conventional whipstock;

Figure 12:
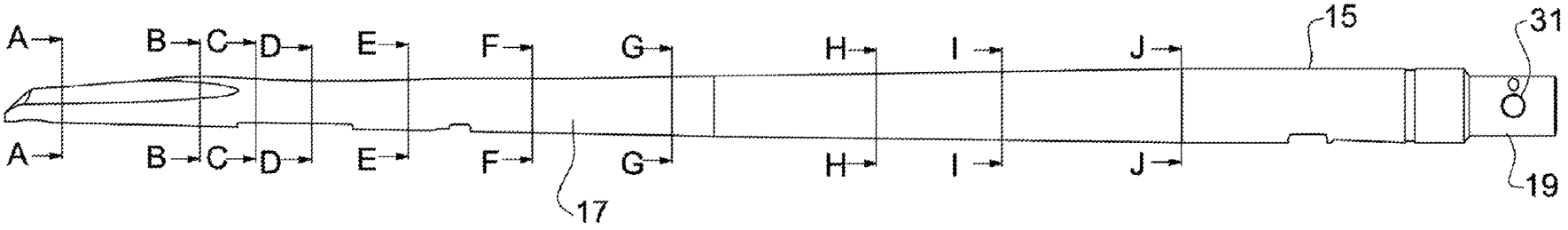
FIG. 12 shows a further view of the whipstock of FIG. 10.
Figure 14A:
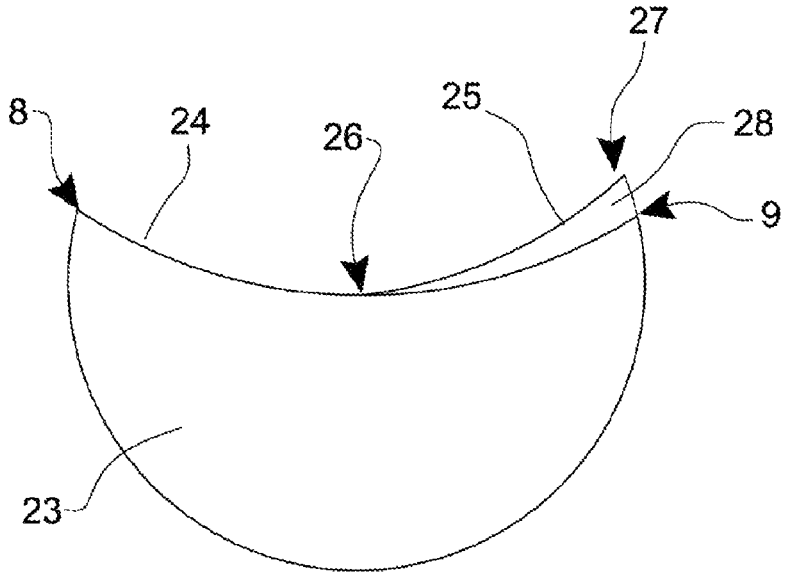
Figure 14B:
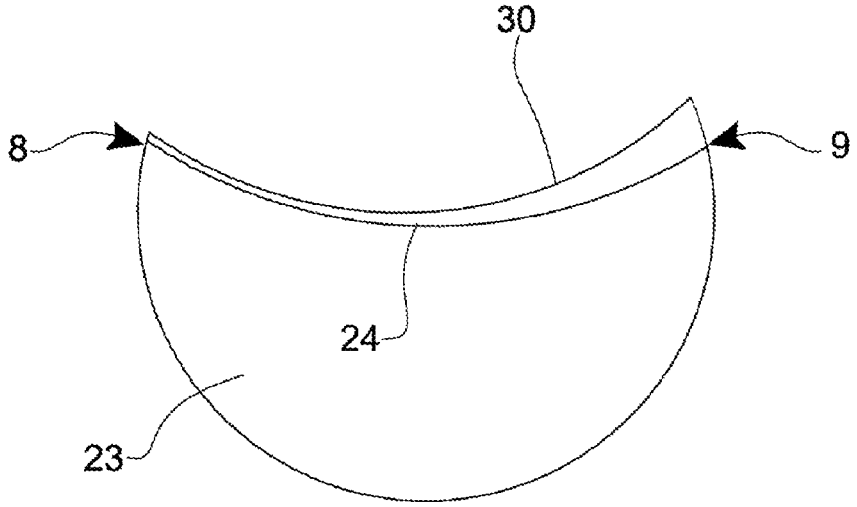

FIGS. 13*a* to 13*j* show cross-sectional views at various points along the length of the whipstock of FIG. 12; and FIGS. 14*a* and 14*b* show whipstocks embodying the present invention with reinforcing elements on the front faces thereof.

Figure 1:
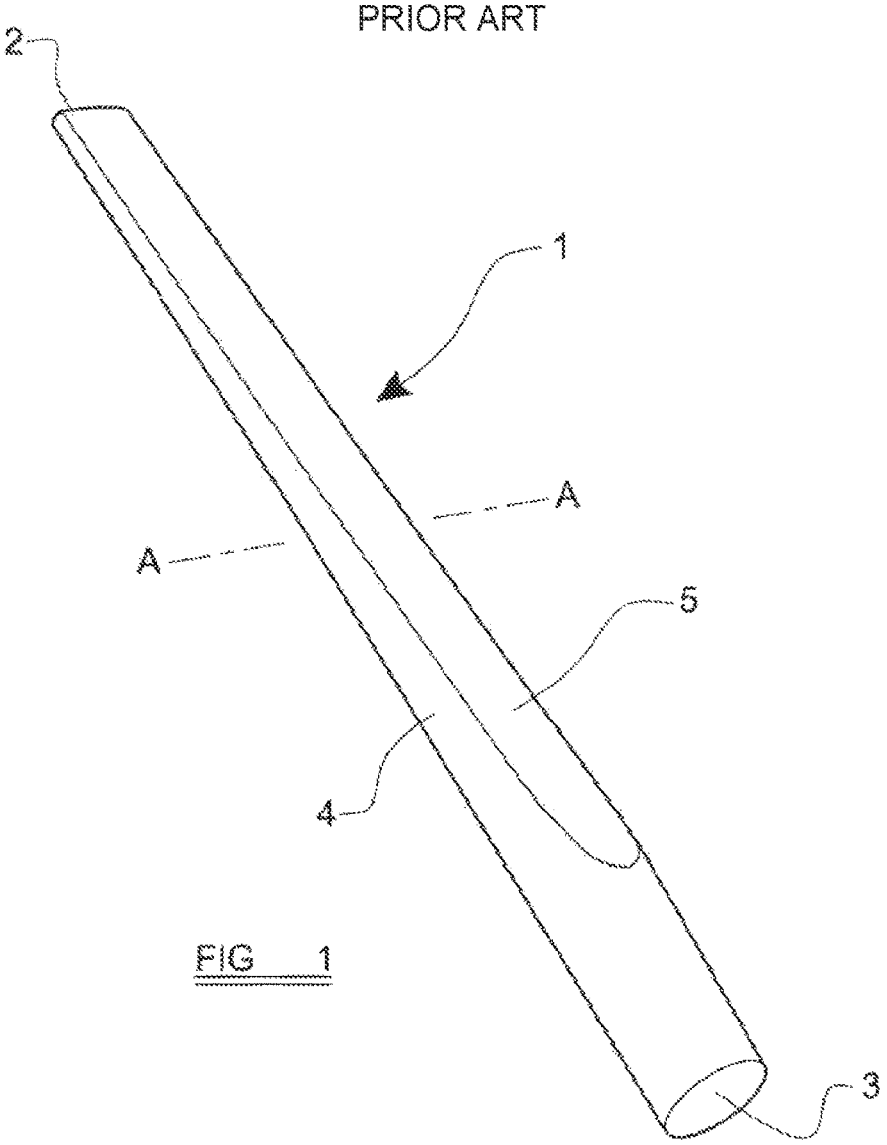
FIG 1 PRIOR ART

FIG. 1 is a schematic view of a known whipstock 1. The whipstock 1 has a top end 2 and a bottom end 3. In use of the whipstock 1, the whipstock 1 will be inserted into a wellbore (not shown) with the bottom end 3 lowermost.

As described above, the thickness of the whipstock 1 is relatively small at its top end 2, and gradually increases along the length of the whipstock 1 until, at its bottom end 3, the whipstock 1 has a generally circular cross-section. In use, this circular cross-section will fill or substantially fill a circular wellbore.

In the region where the whipstock 1 tapers, it has a rear face 4, which has a cross-sectional shape which is part of a circle. The whipstock 1 also has a front face 5 which is tapered, and which acts as a deflection surface in use of the whipstock 1.

Figure 2:
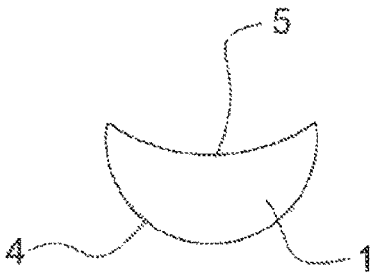
FIG 2 PRIOR ART

FIG. 2 shows a cross-sectional view of the whipstock 1, taken across the whipstock 1 at the point indicated by the dash line indicated by A-A in FIG. 1. This cross-section is therefore taken through a part of the tapered section of the whipstock 1.

As can be seen in FIG. 2, the front face 5 of the whipstock 1 has a concave or trough-like cross-sectional shape. It will be understood that this assists in guiding the milling head as it passes along the length of the front face 5 during the milling of a window in the casing.

Figure 3:
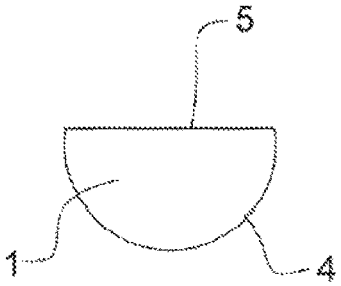

FIG. 3 shows an alternative known design of whipstock or deflector, and is another cross-sectional view through the tapering section of a whipstock, corresponding to the view shown in FIG. 2. In this example the front face 5 has a generally straight cross-sectional shape, i.e. the front face does not have a channel or trough shape.

Figure 4A:
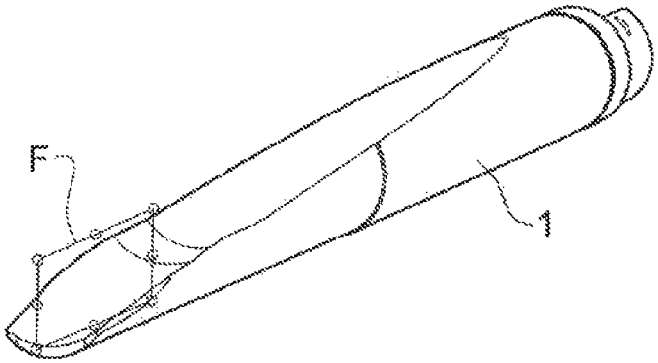
FIG 4a PRIOR ART
Figure 4B:
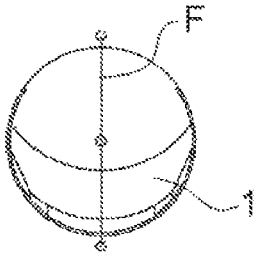
FIG 4b PRIOR ART

FIGS. 4*a* and 4*b* show the front plane F of a conventional whipstock 1. The whipstock is formed by milling away parts of an initial body which is cylindrical, and the front plane F lies on the central longitudinal axis of this initial body. The front plane F contains the central longitudinal axis, and in these figures is defined as lying on the axis of symmetry of the trough shape of the front face 5 of the whipstock 1.

Figure 5A:
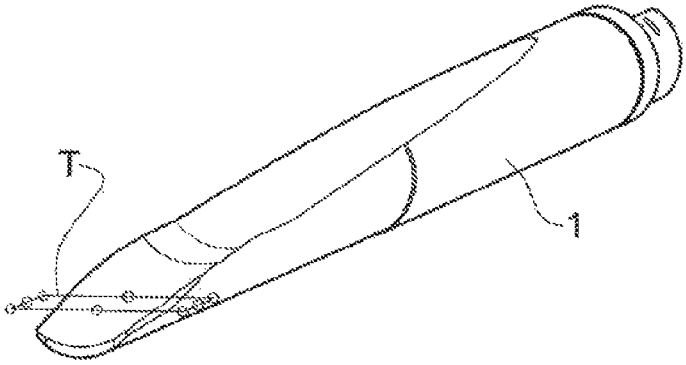
FIG 5a PRIOR ART
Figure 5B:
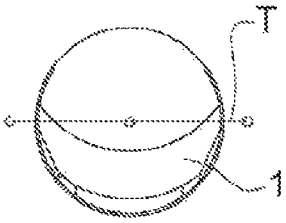
FIG 5b PRIOR ART
Figure 6A:
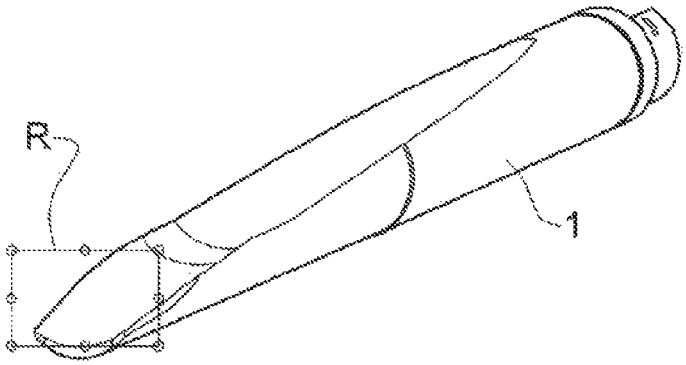
FIG 6a PRIOR ART
Figure 6B:
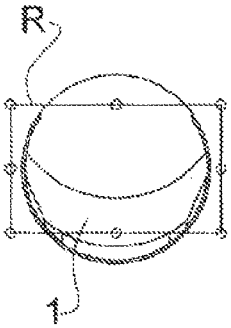
FIG 6b PRIOR ART

For completeness, FIGS. 5*a* and 5*b* show the top plane T of a conventional whipstock 1, which again contains the central longitudinal axis of the initial body, and is at right angles to the front plane, and FIGS. 6*a* and 6*b* show the right plane R of the conventional whipstock, which is perpendicular to the central longitudinal axis of the initial body.

Figure 7:
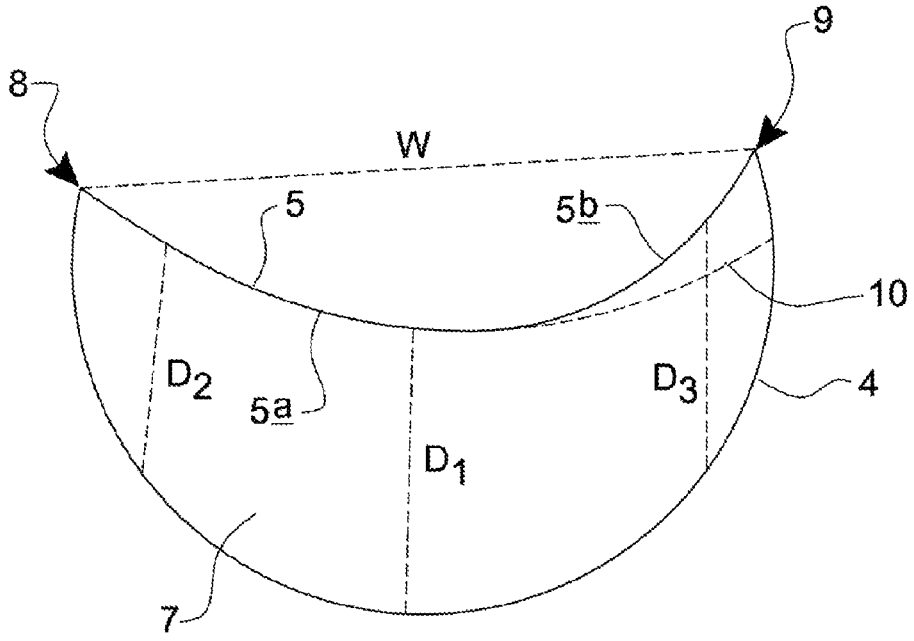
FIG. 7 is a cross-sectional view of a whipstock embodying the present invention.

FIG. 7 shows a cross-sectional view of a whipstock 7 embodying the present invention.

In overall appearance and in configuration, the whipstock 7 embodying the present invention may be similar to the conventional whipstock 1 shown in FIG. 1. The whipstock 7 embodying the invention also has a rear face 4, which has a generally part-circular cross-sectional shape, and a front face 5 which is inclined with respect to the longitudinal axis of the whipstock 7, to produce a tapering deflection section.

As can be seen in FIG. 7, at a point along the length of the deflection section, the front face 5 has a first edge 8 and a second edge 9. The view shown in FIG. 7 is from the perspective of someone looking along the front face 5 from the top end of the whipstock 7 towards the bottom end thereof, with (in this case) the first edge 8 being on the left side of the front face 5 and the second edge 9 being on the right side.

A width W is defined between the first and second edges 8, 9. In this example the width W comprises a straight line, passing between the first and second edges 8, 9.

A first part 5*a* of the front surface 5, which extends from the first edge 8, has the same cross-sectional shape as a conventional trough-shaped whipstock face. In the embodiment shown, the first part 5*a* extends beyond the mid-point of the width W.

However, a second part 5*b* of the front face 5 curves more steeply away from the rear face 4 of the whipstock 7, to meet the second edge 9.

For the purposes of comparison, a dashed line 10 in FIG. 7 shows the cross-sectional shape of a conventional whipstock face, i.e. where the curvature of the front face is symmetrical on both sides thereof. It can be seen that the second part 5*b* of the front face 5 curves away from the rear face 4 significantly more than the shape 10 of a conventional whipstock face.

In some embodiments, the radius of curvature of the first part 5*a* of the front face 5 is less than the radius of curvature of the second part 5*b* of the front face 5. The first and second parts 5*a*, 5*b* of the front face 5 may, for example, be formed using two different cutters, having different diameters. The first and second parts 5*a*, 5*b* of the front face 5 may meet at or near the centre of the front face 5, or may alternatively meet in a region which is spaced apart from the centre of the front face 5, towards either the first edge 8 or the second edge 9 thereof.

In FIG. 7, reference numeral $D_1$ shows the depth of the whipstock 7, which is the distance between the front face 5 and the rear face 4, perpendicular to the width W, at a position which is generally aligned with the midpoint of the width W.

At a position close to the first edge 8, the whipstock 7 has a first depth $D_2$.

At a corresponding distance from the second edge 9, the whipstock 7 has a third depth $D_3$. Importantly, the depth $D_3$ is greater than the second depth $D_2$.

An advantage of this shape of the whipstock 7 relates to wear of the whipstock 7 during use. As will be understood by the skilled reader, in use a milling head will pass along the length of the front face 5, and will be deflected by the front face 5 towards the inner surface of the casing of the wellbore, to mill a window in the casing. In conventional systems, the milling head will be rotating in a clockwise direction, when viewed from a point directly behind the milling head. Referring to FIG. 7, in the orientation shown in FIG. 7, a milling head will lie against the front face 5, rotating in a clockwise direction.

This direction of rotation means that the right-hand portion of the whipstock 7, as seen in the orientation of FIG. 7, will experience significantly more wear than the left-hand portion. This is because the blades or other milling features of the milling head will, as the milling head is rotated, come into contact in the first instance with the right-hand portion of the front face 5 of the whipstock (i.e. the part of the front face 5 which lies closest to the second edge 9).

Users of whipstocks have found that, where a whipstock is being used in the milling of a window in the casing of a bore hole, and the whipstock is subsequently retrieved from the bore hole, the right-hand portion of the whipstock face (if the whipstock face is viewed in a direction passing from the top end to the bottom end thereof) is worn significantly more than the left-hand side, and in some instances can be worn to a very a thin depth.

One disadvantage of this is that, as the milling operation proceeds, the whipstock will be worn into an asymmetric or lopsided configuration, and will not correctly support and guide the milling head during the remainder of the operation.

In preferred embodiments of the invention, the depth of the whipstock 7 near the second edge 9 is at least 5% greater than the depth near the first edge 8. More preferably, the depth $D_3$ near the second edge 9 is more than 10% greater than the depth $D_2$ near the first edge 8. Yet more preferably, the depth $D_3$ near the second edge 9 is at least 20% greater than the depth near the first edge 8.

In any of the above, 'near the first edge' or 'near the second edge' may refer to a position which is 5% of the way along the width W, 10% of the way along the width W, or 20% of the way along the width W, counted from the respective edge 8,9.

Alternatively, or in addition, the radius of curvature of the second part 5*b* of the front face 5 may be less than the radius of curvature of the first part 5*a* thereof by at least 5%, more preferably by at least 10%, and yet more preferably by at least 20%.

In the above description, the depth of the whipstock 7 is greater on its right-hand side, looking along the whipstock face from its top edge towards its bottom edge, than on the left-hand side. As explained above, this preferred configuration arises from the fact that, in conventional milling or drilling operations, the milling/drilling head will rotate in a clockwise direction.

However, it is also anticipated that, in certain applications, this situation may be reversed, i.e. the depth of the whipstock 7 may be greater on the left-hand side, looking along the whipstock face from its top end towards its bottom end, than on the right-hand side.

In preferred embodiments, the depth of the whipstock is greater on one side than on the other for all, or substantially all, of the length of the tapered deflection section of the whipstock. However, this need not be the case, and in other embodiments, the depth of the whipstock may be greater on one side than on the other for only a part of the length of the deflection section.

For instance, the front face 5 of the whipstock 7 may have a shape near its bottom end which has equal depth on both sides thereof, with increased depth on one side only appearing higher up the whipstock face.

In preferred embodiments, one side of the whipstock 7 is deeper than the other side by the same amount along the entirety of the length of the whipstock for which depth is greater on one side than on the other.

However, in other embodiments, the degree of difference in the depth of the whipstock between one side and the other may vary along the length of the whipstock 7.

For instance, the degree of difference of depth may be greater in a first, upper section of the deflection section, with the degree of difference being less in a second, lower region of the deflection section.

This may be, for example, because the required force to drive a milling head laterally against the interior of the casing is greatest at the start of the process of milling a window in the casing. Hence, as the window begins to be milled, the forces acting on the front face 5 of the whipstock 7 (and hence the wear on the whipstock 7) are at a maximum. However, once milling of the window has begun, the forces acting on the front face 5 (and hence the wear on the whipstock 7) are reduced, and hence a lesser difference in depth between one side of the whipstock 7 and the other is needed.

Figure 8:
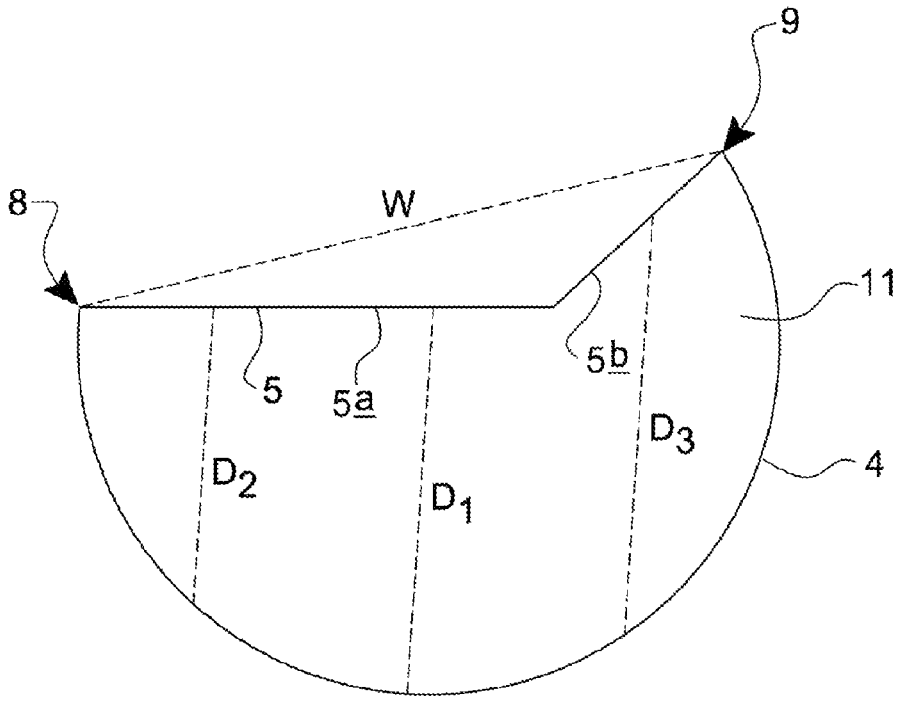
FIG. 8 is a cross-sectional view of a further whipstock embodying the present invention.

FIG. 8 shows an alternative configuration for a whipstock 11 embodying the present invention. In this example the front face of the whipstock does not have a trough.

In this embodiment, the front surface 5 of the whipstock 11 has a first section 5*a* which, in cross section, extends in a straight line for more than half of the width W of the front face 5. The front face 5 turns through an angle at a transition point 12, and has a shorter second section 5*b*, which extends from the transition point 12 to the second edge 9.

Again, the result is that a second depth $D_2$ near the first edge 8, extending at right angles to the width W between the front face 5 and the rear face 4, is less than a third depth $D_3$ at a corresponding distance from the second edge 9.

Figure 9:
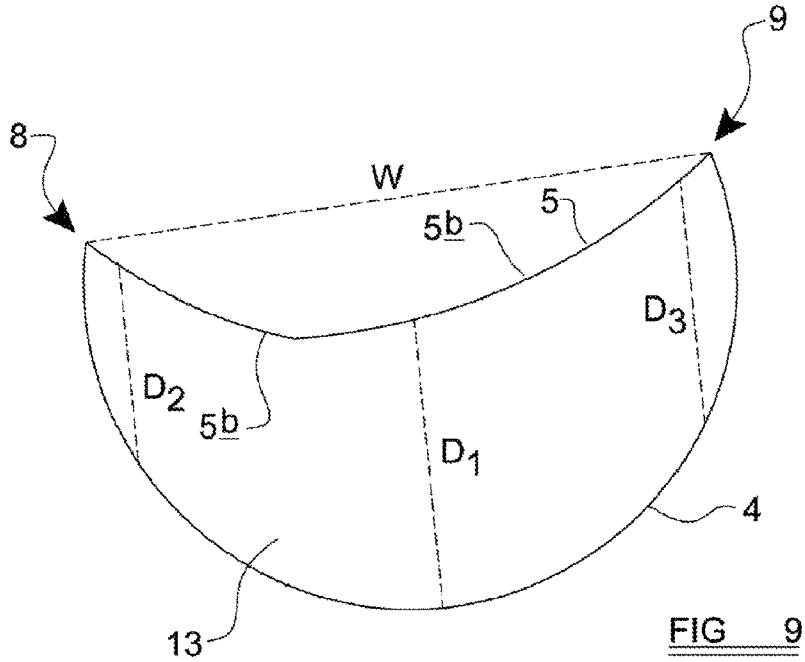
FIG. 9 shows a cross-sectional view of another whipstock embodying the present invention.

FIG. 9 shows a further alternative configuration for a whipstock 13 embodying the present invention. In the example of FIG. 9, again the front face 5 of the whipstock 13 has a first section 5*a* and a second section 5*b*. In this embodiment, both sections 5*a*, 5*b* have the same, or substantially the same, radius of curvature. However, the first and second sections 5*a*, 5*b* meet each other at a transition point 14, at which the front face 5 turns through an angle. This angle is preferably around 1-15°. The transition point 14 is closer to the first edge 8 than to the second edge 9.

This configuration again leads to a greater depth $D_3$ near the second edge 9 than the depth $D_2$ at a corresponding distance from the first edge 8. However, the front face 5 can be produced using the same cutter, having a given outer diameter, to produce sections of the front face 5 which have the same radius of curvature. It is therefore envisaged that this configuration will be relatively easy and straightforward to manufacture.

In preferred embodiments, the transition point 14 is closer to the first edge 8 than to the second edge 9 by at least 5% of the width W of the front face, or of the length of the front face 5 if the front face is followed from the first edge to the second edge. In other embodiments the transition point 14 may be closer to the first edge 8 than to the second edge 9 by at least 10%, or optionally at least 20% of the width W of the front face, or of the length of the front face 5.

In the examples discussed above the depth is defined as being perpendicular to the width W of the front face 5. However, in these examples the depth may equally be defined parallel to the centreline or front plane of the whipstock, which are discussed in more detail below.

Figure 10:
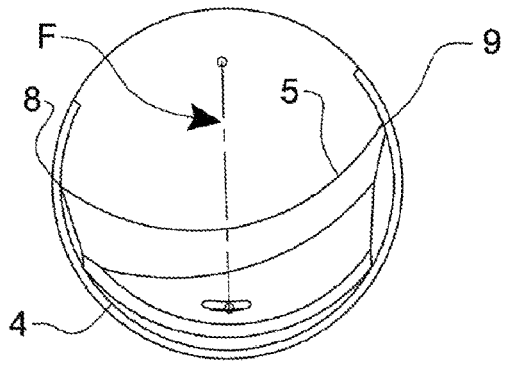
FIG. 10 shows a cross-sectional view of another whipstock embodying the present invention.

FIG. 10 shows a cross-section through a whipstock 15 embodying the present invention. As can be seen in FIG. 10, the whipstock 15 has a rear face 4, which forms part of the arc of a circle, and a front face 5. In this embodiment, the front face 5 has a constant or substantially constant radius of curvature across its width. However, the curvature of the front face is offset with respect to the front plane F of the whipstock 15, which is shown in FIG. 10 in the same position as on FIGS. 4*a* and 4*b*, As can be seen, the front plane F (which may also be referred to as the centreline, as discussed below) is no longer aligned with the axis of symmetry of the trough shape of the front face 5.

Figure 11:
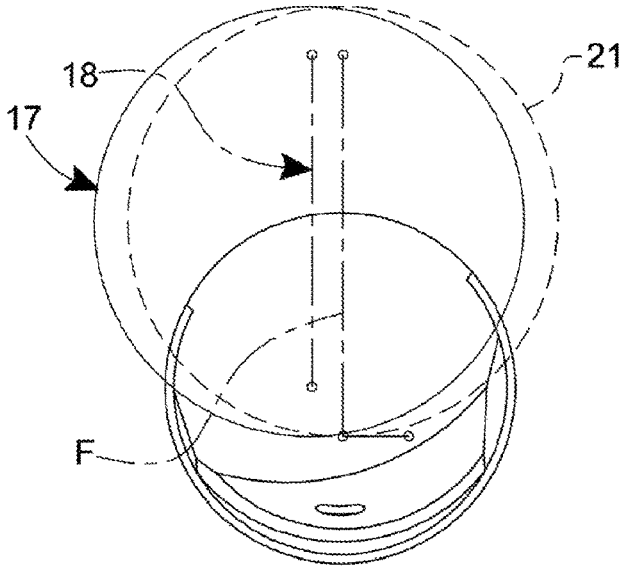
FIG. 11 illustrates how the whipstock of FIG. 10 may be manufactured.

In the embodiment shown in FIG. 10, the front face 5 of the whipstock 15 may be formed using a single cutter 17, which is shown schematically in FIG. 11, and which has a spherical or part-spherical outer profile having a diameter greater than the diameter of the cylinder from which the whipstock 15 is formed. At at least some positions along the length of the whipstock 15, as the cutter 17 forms the front face 5 the cutter 17 is positioned so that its centre 18 is offset with respect to the front plane F of the cylinder, in a direction which is parallel to the front plane F. In FIG. 11 the position of the cutter 17 which would be used to mill a conventional whipstock face is indicated by reference numeral 21. The centre 22 of this position is also shown, to illustrate that, in the example shown in FIGS. 10 and 11, the cutter 17 is offset to the left with respect to the cylinder. The result of this, as can be seen from FIGS. 10 and 11, is to form a front face 5 which has a suitable shape, as described above, where the thickness of the whipstock 15 near the first edge 8 of the front face 5 is less than the thickness of the whipstock 15 near the second edge 9 thereof. In this context, the thickness of the whipstock may be defined in a direction which is parallel or substantially parallel with the front plane F.

The distance of this offset may be, for a standard size of whipstock, between around 1-3 cm, and may preferably be around 1.27 cm (0.5 inches). However, any other suitable offset distance may be used.

In general the diameter of the concave front surface of a whipstock (and hence, when this technique is used, the diameter of the cutter used) may be larger, by a relatively small amount, than the diameter of the milling head that is to be used with the whipstock. For example, the diameter of the concave front surface may be around 0.32 cm (i.e. around 0.125 inches) greater than the diameter of the milling head with which the whipstock is to be used. For instance, with a casing diameter of 17.8 cm (i.e. 7 inches), a whipstock may be formed from an initial bar having a diameter of 14 cm (5.5 inches), and the maximum mill diameter might be 15.9 cm (6.25 inches). The diameter of the concave front face might therefore be around 16.2 cm (6.375 inches). The figures given here are examples, and the invention is not limited to these figures.

In the discussion above, the front face of the whipstock is described as being formed by a single, relatively large cutter with a circular or part-circular outer profile. However, the front face may equally be formed by a smaller cutter which makes several cuts, and where the end result is the desired shape. Such a cutter could, for example, be controlled by a CNC machine. The invention is not limited to front face being formed by a cutter having an outer diameter which matches the curvature of the finished front face, and the desired shape of the front face may be formed by any suitable method.

FIG. 12 again shows the whipstock 15 of FIG. 10. Marked on FIG. 12 are lines showing A, B, C and so on. FIG. 13*a* is a cross-sectional view taken through the whipstock 15 at the point marked by A in FIG. 12. FIG. 13*b* is a cross-sectional view taken through the whipstock 15 at the point marked by B in FIG. 12, and so on up to FIG. 13*j*. In the orientation shown in FIG. 12, the top of the whipstock 15 is on the left, and the bottom of the whipstock 15 is on the right. FIG. 13*a* therefore shows a cross-sectional view taken through a point near the top of the whipstock 15, and FIG. 13*j* shows a cross-sectional view taken through a point near the bottom of the whipstock 15.

It should be noted that the deflection section includes a region over which the front face 5 is parallel with the longitudinal axis of the whipstock 15, as can be seen from the fact that the depth of the whipstock 15 does not increase from the image shown in FIG. 13*c* to the image shown in FIG. 13*d*. This is because the whipstock 15 has a hook slot 32 formed in this region, and providing a parallel part of the front face 5 helps to prevent damage to the whipstock 15 as the milling head passes over the hook slot 32.

In each of FIGS. 13*a* to 13*j*, the centreline 20, which is equivalent to the front plane F discussed above, of the whipstock 15 is shown. The whipstock 15 generally takes the form of a cylinder, with certain parts removed to form an inclined face, and the centreline 20 is (in this example) a straight line which passes through the centre of this cylinder. The centreline 20 extends in a certain direction through the centre of the cylinder.

The centreline 20 generally defines an orientation of the whipstock 15, such that in use of the whipstock 15 the intention is for a window to be milled in the casing of the borehole substantially in line with the centreline 20.

The centreline 20 may be defined in terms of the connections that the whipstock 15 has at its upper and/or lower ends. These connections will allow the whipstock 15 to be connected to other components above and below the whipstock 15, so that the whipstock 15 is oriented with the centreline 20 thereof aligned or substantially aligned with the direction in which the window is to be milled in the casing of the borehole, relative to the whipstock 15. For instance, in many applications a whipstock is connected to an anchor (or similar) at its lower end by a connection that allows relative pivoting motion between the whipstock and the anchor. The connection will generally be arranged such that pivoting may occur between the whipstock and the anchor around a particular axis. In general this axis of rotation is perpendicular (or substantially perpendicular) to the centreline of the whipstock.

For instance, the connection may take the form of a hinged connection. Referring again to FIG. 12, it can be seen that the whipstock 15 has a tang 19 at its lower end, which has a bore 31 formed therethrough. In use, a hinge pin or similar will pass through this bore 31, and the whipstock may then pivot with respect to a lower component (such as an anchor) about this hinge pin.

As an alternative, the whipstock 15 may have a slip (not shown in the figures) at its lower end, which is provided with a pad or similar (which may have a tapering profile), which biases the whipstock 15 to pivot in a particular direction with respect to a lower component (such an arrangement is known, for example, from the Archer X-it™ system, or the Quicktrip or Bottomtrip whipstocks produced by Eaton Oil Tools). This particular direction may be parallel (or substantially parallel) with the centreline of the whipstock.

The skilled reader will understand the reason for this pivoted connection. Aside from allowing the drill string to negotiate bends and turns in a borehole, once a whipstock is set in the borehole it will be released from the component that was attached to its upper end, and the upper end of the whipstock is then free within the borehole, in that it is not attached to any other components. The outer diameter of the whipstock will be somewhat smaller than the inner diameter of the borehole, and this means that the top end of the whipstock will have some freedom of movement within the borehole. It will be preferable if the whipstock pivots so that the top end rests against the inner surface of the borehole opposite the location in which the window is to be milled, as this will provide correct alignment, and reliable support from the borehole, as the milling operation proceeds. For this reason, a connection is formed between the whipstock and the lower component that allows the whipstock to pivot with respect to the lower component only in a direction which is parallel, or substantially parallel, with the centreline of the whipstock.

Alternatively, the centreline 20 may be defined with respect to an initial ramp at the top of the whipstock 15, which initially guides the milling head as it first contacts the whipstock 15. This initial ramp may have an axis of symmetry which is aligned, or substantially aligned, with the centreline 20.

As described above, the difference in depth between one side and the other may be at its greatest in an upper region of the whipstock, and then reduce in one or more regions lower down the whipstock. In any embodiment described herein, in a lowest region of the deflection section, the difference in depth may be zero, i.e. the front face of the whipstock has a generally symmetrical shape, akin to that of a conventional whipstock.

If the front face is formed using a cutter with a diameter larger than the diameter of the whipstock itself, then the amount of the offset between the cutter and the whipstock body may reduce, either gradually or in one or more steps, along the length of the whipstock, so that the difference in depth between the sides of the whipstock correspondingly reduces along the length of the whipstock.

This may lead (as with other embodiments described herein) to a whipstock face which effectively has a twisted configuration—the front face has an axis of symmetry which points in a first radial direction in a first region at or near the top of the deflection section, and points in a second radial direction in a second region which is at or near the bottom of the deflection section.

In use, it is envisaged that a whipstock embodying the present invention may be used with a milling arrangement having a series of spaced apart milling heads. For instance, a first milling head may have a relatively small diameter, and a second (and optionally also a third) milling head which is positioned above the first milling head may have a greater diameter, and may be 'full bore', i.e. generally matching the internal diameter of the wellbore.

The skilled reader will appreciate how a milling system of this type will operate.

Alternatively, only a single milling head may be used in a milling operation involving a whipstock embodying the invention.

In some known whipstocks, a relatively short ramp, which is inclined at a greater angle with respect to the longitudinal axis of the whipstock by a greater degree than the main whipstock face, may be included on the whipstock face. A ramp of this kind may protrude from the whipstock face. A ramp of this kind may be provided at or near the top end of the tapered deflection face, to drive the milling head towards the casing of the wellbore as the milling head begins milling a window in the wellbore, to help start the milling process effectively. In some embodiments the ramp may be sacrificial, in that it is intended to be milled away partially or entirely during the milling operation. In some embodiments two or more ramps may be provided on the whipstock. Where one or more ramps of this kind are provided, they may also have increased thickness on one side compared to the other side. Preferably, the increased thickness of the ramp(s) is on the same side as the increased thickness on the main part of the whipstock.

It is also envisaged that, if more than one ramp is provided, one ramp may have increased thickness on one side, and one ramp may be symmetrical or substantially symmetrical. This may be useful, for instance, to begin milling a window in the casing with a symmetrical ramp, i.e. to break through the casing, and for a subsequent ramp to have increased thickness on one side to ensure that the milling head is appropriately supported as the window is milled into an elongate shape.

In the discussion above, the whipstocks have a rear surface that has a cross-sectional shape of part of a circle. As discussed, such whipstocks will generally be formed by milling away part of an initial body which has a cylindrical shape.

However, whipstocks embodying the present invention may have a rear face taking any suitable shape. For instance, the cross-sectional shape of the whipstock could take the form of a part of a square, a rectangle, a triangle, a hexagon, an octagon, an ellipse, or any other desired shape. As the skilled reader will appreciate, such whipstocks may (although need not necessarily) be formed by milling away part of an initial body which is, in cross-section, square, rectangular, etc.

The whipstocks discussed above are primarily formed from a single piece of material, and this piece of material makes up all or substantially all of the front face of the deflection section. For instance, an initial cylindrical body may be provided, and parts of this initial body may be milled away to produce a whipstock having a deflection section.

In other embodiments of the invention, one or more reinforcing elements may be attached to the front face, to provide reinforcement and to increase the depth of the front face in selected regions.

FIG. 14*a* shows a whipstock 23. The whipstock 23 is formed by milling a trough into an initial body, formed from a unitary, cylindrical piece of material, to produce an initial front face 24 which is generally symmetrical, i.e. resembling the front face of a conventional whipstock, having a first edge 8 and a second edge 9, as discussed above.

A reinforcement element 25 is attached to one side of the initial front face 24 of the whipstock 23. In this example, the reinforcement element 25 is positioned on the right-hand side, as one looks down the whipstock from the top end thereof to the bottom. The reinforcement element 25 extends from a first edge 26 thereof, which lies close to the centre of the initial front face 24, and extends to a second edge 27 which lies at or near the second edge 9 of the initial front face 24. The reinforcement element 25 has a generally wedge-shaped cross-section, having a depth 28 at its second edge 27, and tapering to a point at its first edge 26.

The reinforcement element is connected robustly to the initial front face 24, for instance by welding, to create a final front face. The reinforcement element provides an increased depth near the second edge 9, compared to the depth at a corresponding distance from the first edge 8. Also, the reinforcement element 25 is preferably formed from a material that is harder than the material from which the remainder of the whipstock 23 is formed, e.g. hardened steel. The reinforcement element 25 will therefore also increase the resilience of the whipstock face where this is most needed.

FIG. 14*b* shows a further whipstock 29, which is once again formed by milling a trough into an initial body, formed from a unitary, cylindrical piece of material, to produce an initial front face 24 which is generally symmetrical, i.e. resembling the front face of a conventional whipstock, having a first edge 8 and a second edge 9, as discussed above.

A further reinforcing element 30 is fixed to the initial front face 24. In this embodiment, the further reinforcing element 30 extends all or substantially all of the way across the initial front face 24, from the first edge 8 to the second edge 9 thereof.

The further reinforcing element 30 has a first, relatively small, depth near the first edge 8 of the initial front face 24, and in the region of the further reinforcing element 30 between the first edge 8 and the centre of the initial front face 24. However, in the region between the centre of the initial front face 24 and the second edge 9, the depth of the reinforcing element 30 increases, to reach a maximum depth at or near the second edge 9.

The skilled reader will understand that the reinforcing element 30 once again provides additional resilience to the whipstock 29, and increases the overall depth of the whipstock near the second edge 9, compared to the depth near the first edge 8.

The reinforcement element may take any suitable shape. In addition, two or more reinforcement elements may be attached to an initial face of a whipstock, on different regions of the initial face, and/or overlapping each other.

In some embodiments, one or more reinforcement elements may be applied to the whipstock face at or near its top end, to provide additional depth and resilience where it is most needed, i.e. in the location where the milling head will begin milling a window in the casing of the borehole. However, further down the whipstock, no reinforcement element may be present. Alternatively, a thicker and/or more extensive reinforcement element may be present in an upper region of the whipstock, compared to a lower region. For instance, near the top of the whipstock, a reinforcement element may have a cross-section which is similar to that shown in FIG. 15*b*, but near the bottom of the whipstock a reinforcement element may have a cross-section which is similar to that shown in FIG. 15*a*. These different shapes may be provided by a single reinforcement element which changes cross-sectional shape along its length, or by a first reinforcement element provided near the top of the whipstock, and a second, separate reinforcement element provided near the bottom of the whipstock. These two reinforcement elements may be contiguous or substantially contiguous, to provide a smooth transition as the milling head passes from one to the other.

As an alternative to (or in addition to) adding one or more reinforcement elements, in some embodiments one side of the whipstock face may be heat-treated (or otherwise treated) so that it has a higher hardness than the other side of the face. As discussed above, in most applications it is expected that the right-hand side of the front face (as one looks along the front face from the top of the whipstock) will experience greater wear than the left-hand side of the front face, and it is therefore preferred that the right-hand side of the front face is heat-treated to have a higher hardness than the left-hand side. In these embodiments, the left-hand side may not be heat-treated at all, or may be heat treated differently to, or to a lesser extent than, the right-hand side. The treatment of the right-hand side to have a higher hardness than the left-hand side may be done for only a part of the length of the deflection section, and for instance this may be done only in an upper region of the front face, and not (or to a lesser extent) in a lower region of the front face.

As discussed, it is expected that the greatest forces may be encountered when the milling head is adjacent the upper part of the front face.

It is envisaged that the treatment of one side of the front face to have a higher hardness than the other side of the front face will be beneficial even when the deflection section does not have a greater depth on one side than on the other side. The treatment of one side of the front face to have a higher hardness than the other side of the front face, when applied to a conventional, symmetrical whipstock face, comprises an aspect of the present invention.

The discussion above relates to whipstocks before they have been used in a milling operation. It is known that, after being used in a milling operation, a whipstock may have a greater depth on one side than the other—as mentioned above, for instance, a conventional whipstock may be significantly more worn down on one side than the other following a milling operation, and this is related to the problem that is addressed by the whipstocks discussed herein. For the avoidance of doubt, a whipstock that has been used in a milling operation is not intended to fall within the scope of the present invention.

The skilled reader will appreciate that whipstocks embodying the invention will display advantages with regard to the milling of apertures or windows in the casing of a wellbore, and will do so more reliably and consistently than conventional whipstocks.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A whipstock, comprising:

a longitudinal axis, a first end and a second end, and a tapering deflection section extending at least part of a length between the first end and the second end, wherein:

the deflection section has a rear face;

the deflection section has a front face, which in use will deflect a milling arrangement in a direction having a component which is perpendicular to the longitudinal axis of the whipstock, the front face having first and second side edges and a width defined between the first and second side edges; and a depth of the deflection section is defined as a distance between the rear face and the front face;

wherein the front face of the deflection section is asymmetrical relative to a front plane that includes the longitudinal axis and intersects the front face and the rear face, and wherein at a first distance transverse from the first side edge and not on the front plane, a first depth of the deflection section measured at a first predetermined length along the deflection section is greater than a second depth of the deflection section measured at the first distance transverse from the second side edge and at the first predetermined length along the deflection section.

2. The whipstock according to claim 1, wherein the first depth of the whipstock at the distance transverse from the first side edge is at least 5% greater than the second depth of the whipstock at the first distance transverse from the second side.

3. The whipstock according to claim 1, wherein the first distance is 5% of the width, is 10% of the width, or is 20% of the width, in a direction from the respective edge towards the centre of the width of the front face.

4. The whipstock according to claim 1, wherein the front face of the whipstock has a first section, which is near to or adjoins the first edge, and a second section which is near to or adjoins the second edge, and wherein a radius of curvature of the second section is less than a radius of curvature of the first section.

5. The whipstock according to claim 4, wherein the first and second sections of the front face meet at an angle.

6. The whipstock according to claim 4, wherein at least one of the first and second sections of the front face is straight or substantially straight.

7. The whipstock according to claim 1, wherein the front face of the whipstock has a first section, which is near to or adjoins the first edge, and a second section which is near to or adjoins the second edge, and wherein the first and second sections have the same or substantially the same radius of curvature.

8. The whipstock according to claim 1, where a radius of curvature of the front face is constant or substantially constant across the width of the front face.

9. The whipstock according to claim 8, where the front face has a centre of curvature which is offset with respect to a centre of curvature of the rear face.

10. The whipstock according to claim 1, wherein at at least one predetermined length along the deflection section, the whipstock has a centreline thereof defined, the centreline passing through the longitudinal axis of the whipstock at a predetermined angle.

11. The whipstock according to claim 10, wherein the centreline is defined as being aligned or substantially aligned with respect to one or more attachment elements at one or both of the first and second ends of the whipstock.

12. The whipstock according to claim 10, wherein the centreline is defined as being aligned or substantially aligned with an initial ramp, which is provided at the first end of the whipstock, and which will guide a milling head as the milling head first contacts the whipstock during use.

13. The whipstock according to claim 10 wherein the front face has a centre of curvature which is offset with respect to a centre of curvature of the rear face in a direction which is perpendicular to the centreline.

14. The whipstock according to claim 1, wherein the depth of the deflection section at the first distance from the first side edge is greater than the depth of the deflection section at the first distance from the second side edge for all or substantially all of the length of the deflection section of the whipstock.

15. The whipstock according to claim 1, wherein the depth of the deflection section at the first distance from the first side edge is greater than the depth of the deflection section at the first distance from the second side edge for only a part of the length of the deflection section of the whipstock.

16. The whipstock according to claim 1, wherein the amount by which the depth of the deflection section at the first distance from the first side edge is greater than the depth of the deflection section at the first distance from the second side edge varies over the length of the deflection section.

17. A method of forming an aperture in the casing of a wellbore, comprising the steps of:

providing a whipstock according to claim 1;

setting the whipstock in place in a wellbore at predetermined depth, and at a predetermined radial orientation with respect to the wellbore; and driving a milling head downwardly over the front face of the whipstock, to mill an aperture in a casing of the wellbore.

18. The method according to claim 17 wherein:

during the milling of the aperture, the milling head is in contact with the front face of the whipstock; and during the milling of the aperture, the milling head is rotated in a direction such that a point on the outer surface of the milling head passes across the front face of the whipstock in a direction which passes from the first side edge to the second side edge.

19. A method of forming a whipstock, comprising the steps of:

providing a body;

providing a cutter; and using the cutter to mill away at least part of the body and thereby form a tapered deflection section having a front face, wherein a rear face of the deflection section comprises an outer surface of the body which has not been milled by the cutter, generally opposite the front face, wherein at least part of the body is milled away by the cutter such that the front face of the deflection section is asymmetrical relative to a front plane that includes the longitudinal axis and intersects the front face and the rear face, and wherein at a first distance transverse from the first side edge and not on the front plane, a first depth of the deflection section measured at a first predetermined length along the deflection section is greater than a second depth of the deflection section measured at the first distance transverse from the second side edge and at the first predetermined length alma the deflection section.

20. The method according to claim 19, wherein:

the body is initially, over at least a region of its length, substantially cylindrical, having a first diameter;

the cutter is shaped so that it removes material from the body in a shape which is circular or part-circular, or substantially circular or part-circular, having a second diameter which is greater than the first diameter; and during at least part of the milling operation, the centre of curvature of the circular or part-circular shape is offset with respect to the centre of curvature of the body, in a direction which is perpendicular to a centreline of the body.

* * * * *